US006461476B1

(12) United States Patent
Goulet et al.

(10) Patent No.: US 6,461,476 B1
(45) Date of Patent: Oct. 8, 2002

(54) UNCREPED TISSUE SHEETS HAVING A HIGH WET:DRY TENSILE STRENGTH RATIO

(75) Inventors: Mike Thomas Goulet, Neenah; Heath David Van Wychen, Kimberly, both of WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/863,612

(22) Filed: May 23, 2001

(51) Int. Cl.[7] ..... D21H 21/18; D21H 21/22

(52) U.S. Cl. ..... 162/158; 162/109; 162/164.3; 162/164.6; 162/175; 162/177

(58) Field of Search ..... 162/109, 164.1, 162/164.3, 178, 177, 183, 158

(56) References Cited

U.S. PATENT DOCUMENTS

| | | | | |
|---|---|---|---|---|
| 3,755,220 A | | 8/1973 | Freimark et al. | |
| 5,316,623 A | * | 5/1994 | Espy | 162/177 |
| 5,318,669 A | * | 6/1994 | Dasgupta | 162/178 |
| 5,397,435 A | * | 3/1995 | Ostendorf et al. | 162/177 |
| 5,593,545 A | | 1/1997 | Rugowski et al. | |
| 5,607,551 A | | 3/1997 | Farrington, Jr. et al. | |
| 5,672,248 A | | 9/1997 | Wendt et al. | |
| 5,785,813 A | * | 7/1998 | Smith et al. | 162/178 |
| 6,162,237 A | | 12/2000 | Chan | |
| 6,241,853 B1 | * | 6/2001 | Smith et al. | 162/178 |

OTHER PUBLICATIONS

Chan, Lock L., editor, "Wet–Strength Resins and Their Application," TAPPI, 1994, pp. 26–28.

Taylor, David L., "Mechanism of Wet Tensile Failure," TAPPI, vol. 51, No. 9, Sep. 1968, pp. 410–413.

* cited by examiner

*Primary Examiner*—Peter Chin
(74) *Attorney, Agent, or Firm*—Gregory E. Croft

(57) ABSTRACT

The ratio of the wet tensile strength to the dry tensile strength of uncreped throughdried tissues and towels can be increased by treating the papermaking pulp with a debonder, a wet strength agent and a dry strength agent. The properties of the resulting product can be manipulated to either provide a product with normal degree of softness (as measured by the machine direction sheet stiffness) and a high wet strength, or a normal degree of wet strength and a higher degree of softness.

42 Claims, 4 Drawing Sheets

UNCREPED TISSUE SHEETS HAVING A HIGH WET:DRY TENSILE STRENGTH RATIO

BACKGROUND OF THE INVENTION

For tissue products such as facial and bath tissue and paper towels, strength and softness are important properties to many consumers. The strength properties of a product can be expressed in terms of wet strength and dry strength. The dry strength is important from the standpoint of manufacturing, since the product must have sufficient strength to pass through various stages in the manufacturing where the sheet is unsupported and under tension. In the case of paper towels, for example, the dry strength must also be sufficient to enable a towel sheet to be detached from a roll of perforated sheets without tearing and to perform tasks in the dry state without shredding. The wet strength is particularly important because towels are routinely used to wipe up spills. As such, it is necessary that the towel hold up in use after it has been wetted. The amount of wet tensile strength developed using conventional alkaline curing wet strength resins, such as polyamide-epichlorohydrin (PAE) resins (i.e. Kymene® resins from Hercules, Inc.) has been found in practice to be a function of the dry tensile strength of the sheet. Depending upon the furnish, the resin addition level and the water chemistry conditions, the wet tensile strength is generally limited to about 30–40 percent of the dry tensile strength of the sheet. Thus, in order to make tissue or paper products with a high level of wet tensile strength, one has to also develop a high level of dry tensile strength.

Unfortunately, tissues and towels with high dry tensile strengths also exhibit high stiffness and therefore poor hand feel properties since the properties of softness (as characterized by low stiffness) and strength are inversely related. As strength is increased (both wet and dry strength), softness is decreased. Conversely, as softness is increased, the strength is decreased. A high wet/dry strength ratio is desired to provide superior durability when wet, while at the same time exhibiting low stiffness and desirable handfeel properties when dry.

Hence there is a need for a means to increase the wet strength/dry strength ratio while maintaining or decreasing the stiffness of the sheet.

SUMMARY OF THE INVENTION

It has now been discovered that the ratio of the wet tensile strength to the dry tensile strength of a paper sheet, such as an uncreped tissue or towel sheet, can be substantially increased by properly treating the furnish, including adding appropriate amounts of a debonder, a wet strength agent and a dry strength agent. This discovery provides the flexibility to produce a tissue or towel product with increased wet strength while maintaining the current level of stiffness or, alternatively, maintaining the current level of wet strength while reducing the stiffness.

Hence, in one aspect, the invention resides in a method of treating a papermaking pulp useful for making a paper sheet, the method comprising: (a) adding a quaternary ammonium debonder to the pulp in an amount sufficient to significantly reduce the dry cross-machine direction (CD) tensile strength of the sheet; (b) thereafter adding a wet strength agent to the pulp in an amount sufficient to provide the sheet with a ratio of the wet CD tensile strength to the dry CD tensile strength (hereinafter the "Wet/Dry Ratio") of 0.50 or greater; and (c) thereafter adding a dry strength agent to the pulp in an amount sufficient to increase the dry CD tensile strength of the sheet.

In another aspect, the invention resides in a method of treating an aqueous dispersion of papermaking pulp useful for producing an uncreped throughdried paper sheet comprising: (a) adding to the aqueous dispersion of papermaking pulp from about 5 to about 30 pounds of a quaternary debonder per metric ton of dry fiber; (b) thereafter adding to the pulp from about 5 to about 30 pounds of a wet strength agent per metric ton of dry fiber; and (c) thereafter adding to the pulp from about 5 to about 20 pounds of a dry strength agent per metric ton.

In another aspect, the invention resides in an uncreped paper sheet, such as a tissue or towel sheet, comprising from about 5 to about 30 pounds of a quaternary amine debonder per metric ton of dry fiber, from about 5 to about 30 pounds of a polyamide-epichlorohydrin wet strength resin per metric ton of dry fiber and from about 5 to about 30 pounds of a dry strength agent per metric ton of dry fiber, said paper sheet having Wet/Dry Ratio of 0.50 or greater and a machine direction stiffness of about 30 kilograms or less per 3 inches of width.

In another aspect, the invention resides in an uncreped paper sheet, such as a tissue or towel sheet, comprising from about 5 to about 30 pounds of a quaternary ammonium debonder per metric ton of dry fiber, from about 5 to about 30 pounds of a polyamide-epichlorohydrin wet strength resin per metric ton of dry fiber and from about 5 to about 30 pounds of a dry strength agent per metric ton of dry fiber, wherein the ratio of the Wet/Dry Ratio to the machine direction stiffness is about 1.5 or greater.

The amount of the quaternary ammonium debonder can be about 5 pounds or greater per metric ton of dry fiber, more specifically from about 5 to about 30 pounds per metric ton of dry fiber, still more specifically from about 10 to about 25 pounds per metric ton of dry fiber. Suitable quaternary ammonium debonders include those chemistries containing one or more aliphatic hydrocarbon groups designed to disrupt hydrogen bonding in a paper, tissue or towel product made from wood fibers. Particularly suitable quaternary ammonium debonders include imidazoline quaternary ammonium debonders, such as oleyl-imidazoline quaternaries, dialkyl dimethyl quaternary debonders, ester quaternary debonders, diamidoamine quaternary debonders, and the like. A specific suitable imidazoline quaternary is 1-methyl-2-noroleyl-3-oleyl amidoethyl imidazolinium methylsulfate available from Goldschmidt Corp. under the designation C-6027.

The amount of the wet strength agent can be about 5 pounds or greater per metric ton of dry fiber, more specifically from about 5 to about 30 pounds per metric ton of dry fiber, still more specifically from about 10 to about 25 pounds per metric ton of dry fiber. Suitable wet strength agents include all chemistries capable of forming covalent bonds with cellulose fibers. Alkaline-curing polymeric amine-epichlorohydrin resins, such as polyamide epichlorohydrin resins, poly(diallylamine) epichlorohydrin resins and quaternary ammonium epoxide resins are particularly advantageous. A particularly suitable wet strength agent is a polyamide-epichlorohydrin resin sold by Hercules, Inc. under the trademark Kymene® 6500.

The amount of dry strength agent can be about 5 pounds or greater per metric ton of dry fiber, more specifically from about 5 to about 20 pounds per metric ton of dry fiber. Suitable dry strength agents include all chemistries capable of forming hydrogen bonds with cellulose. These strength resins may include modified starches and gums, modified cellulose polymers and synthetic polymers, including modified polyacrylamide polymers. A particularly suitable dry strength agent is carboxymethylcellulose (CMC), such as one available from Hercules Inc. as Aqualon® CMC 7MCT.

As used herein, dry CD tensile strengths represent the peak load per sample width when a sample is pulled to rupture in the cross-machine direction. The sample must be dry and have been conditioned at 73° F., 50% relative humidity for at least 4 hours prior to testing. Samples are prepared by cutting a 3 inch wide×5 inch long strip in the cross-machine direction (CD) orientation. The instrument used for measuring tensile strengths is an MTS Systems Synergie 100. The data acquisition software was MTS TestWorks® 3.10 (MTS Systems Corp., Research Triangle Park, N.C.). The load cell is selected from either a 50 Newton or 100 Newton maximum, depending on the strength of the sample being tested, such that the majority of peak load values fall between 10–90% of the load cell's full scale value. The gauge length between jaws is 4+/−0.04 inches. The jaws are operated using pneumatic-action and are rubber coated. The minimum grip face width is 3 inches and the approximate height of a jaw is 0.5 inches. The crosshead speed is 10 +/−0.4 inches/min. The sample is placed in the jaws of the instrument, centered both vertically and horizontally. The test is then started and ends when the specimen breaks. The peak load is recorded as the "CD dry tensile strength" of the specimen. Ten (10) representative specimens are tested for each product and the arithmetic average of all ten individual specimen tests is the CD tensile strength for the product.

Wet tensile strength measurements are measured in the same manner, but after the center portion of the previously conditioned sample strip has been saturated with distilled water immediately prior to loading the specimen into the tensile test equipment. More specifically, prior to performing a wet CD tensile test, the sample must be aged to ensure the wet strength resin has cured. Two types of aging were practiced: natural and artificial. Natural aging was used for older samples that had already aged. Artificial aging was used for samples that were to be tested immediately after or within days of manufacture. For natural aging, the samples were held at 73° F., 50% relative humidity for a period of 12 days prior to testing. Following this natural aging step, the strips are then wetted individually and tested. For artificially aged samples, the 3 inch-wide sample strips were heated for 6 minutes at 105+/−2° C. Following this artificial aging step, the strips are then wetted individually and tested. Sample wetting is performed by first laying a single test strip onto a piece of blotter paper (Fiber Mark, Reliance Basis 120). A pad is then used to wet the sample strip prior to testing. The pad is a green, Scotch-Brite brand (3M) general purpose commercial scrubbing pad. To prepare the pad for testing, a full-size pad is cut approximately 2.5 inches long by 4 inches wide. A piece of masking tape is wrapped around one of the 4 inch long edges. The taped side then becomes the "top" edge of the wetting pad. To wet a tensile strip, the tester holds the top edge of the pad and dips the bottom edge in approximately 0.25 inches of distilled water located in a wetting pan. After the end of the pad has been saturated with water, the pad is then taken from the wetting pan and the excess water is removed from the pad by lightly tapping the wet edge three times across a wire mesh screen. The wet edge of the pad is then gently placed across the sample, parallel to the width of the sample, in the approximate center of the sample strip. The pad is held in place for approximately one second and then removed and placed back into the wetting pan. The wet sample is then immediately inserted into the tensile grips so the wetted area is approximately centered between the upper and lower grips. The test strip should be centered both horizontally and vertically between the grips. (It should be noted that if any of the wetted portion comes into contact with the grip faces, the specimen must be discarded and the jaws dried off before resuming testing.) The tensile test is then performed and the peak load recorded as the CD wet tensile strength of this specimen. As with the dry CD tensile test, the characterization of a product is determined by the average of ten representative sample measurements.

As used herein, "machine direction stiffness" is equal to the measured slope of the stress vs. strain curve obtained from the machine direction, dry tensile measurement. Upon completion of each tensile measurement, the MTS TestWorks® 3.10 data acquisition system calculates the "slope" using the gradient of the least-squares line fitted to the load-corrected strain points falling between a specimen-generated force of 70 to 157 grams (0.687 to 1.540 N), divided by the specimen width. The reported stiffness of a sample is the arithmetic average of ten representative sample measurements.

Suitable uncreped throughdrying processes useful for making tissue and towel sheets in accordance with this invention are well known in the tissue and towel papermaking art. Such processes are described in U.S. Pat. No. 5,607,551 issued Mar. 4, 1997 to Farrington et al., U.S. Pat. No. 5,672,248 issued Sep. 30, 1997 to Wendt et al. and U.S. Pat. No. 5,593,545 issued Jan. 14, 1997 to Rugowski et al., all of which are hereby incorporated by reference.

Suitable papermaking fibers useful for purposes of this invention include both bleached and unbleached hardwood fibers, bleached or unbleached softwood fibers, bleached or unbleached recycled fiber, synthetic fibers, non-woody fibers and blends of these fiber types. For towel applications, bleached softwood kraft fibers or a combination of bleached softwood kraft and bleached softwood chemithermomechanical pulp (BCTMP) fibers are particularly suitable.

The consistency of the aqueous papermaking pulp suspension when the debonder, wet strength agent and dry strength agent are added to the pulp can be any consistency suitable for the papermaking process. Specifically, the consistency can be about 5 percent or less, more specifically from about 1 percent to about 5 percent, still more specifically from about 2 percent to about 4 percent.

The basis weight of the uncreped sheets of this invention can be about 10 grams or greater per square meter, more specifically from about 25 to about 60 grams per square meter (gsm), still more specifically from about 30 to about 50 gsm.

The geometric mean dry tensile strength of the uncreped sheets of this invention can be from about 500 to about 7000 grams per 3 inches of sample width, more specifically from about 1000 to about 4000 grams per 3 inches of sample width, and still more specifically from about 1500 to about 3500 grams per 3 inches of sample width.

The dry CD tensile strength of the uncreped sheets of this invention can be from about 3500 grams or less per 3 inches sample width, more specifically about 3000 grams or less per 3 inches sample width, more specifically about 2500 grams or less per 3 inches sample width, more specifically about 2000 grams or less per 3 inches sample width, more specifically about 1500 grams or less per 3 inches sample width, more specifically about 1000 grams or less per 3 inches sample width, and more specifically about 500 grams or less per 3 inches sample width.

The wet CD tensile strength of the uncreped sheets of this invention can be from about 400 grams or greater per 3 inches of sample width, more specifically about 600 grams or greater per 3 inches of sample width, more specifically about 900 grams or greater per 3 inches of sample width, more specifically about 1200 grams or greater per 3 inches of sample width, more specifically about 1600 grams or greater per 3 inches of sample width, more specifically about 1800 grams or greater per 3 inches of sample width, more specifically from about 400 to about 2000 grams per 3 inches of sample width, and still more specifically from about 800 to about 1800 grams per 3 inches of sample width.

The Wet/Dry Ratio of the uncreped sheets of this invention can be 0.50 or greater, more specifically 0.60 or greater, more specifically from 0.50 to about 1.00, still more specifically from 0.55 to about 0.80, and still more specifically from 0.55 to about 0.75.

The machine direction (MD) stiffness of the uncreped sheets of this invention can be from about 30 kilograms or less per 3 inches of sample width, more specifically about 25 kilograms or less per 3 inches of sample width, more specifically about 20 kilograms or less per 3 inches of sample width, more specifically about 15 kilograms or less per 3 inches of sample width, and still more specifically from about 5 to about 30 kilograms per 3 inches of sample width.

The ratio of the Wet/Dry Ratio to the machine direction stiffness can be about 1.5 or greater, more specifically from about 1.5 to about 4, and still more specifically from about 2 to about 4.

DETAILED DESCRIPTION OF THE DRAWINGS

The various Figures will be discussed in more detail in connection with the description of the Examples below.

EXAMPLES

Example 1

Comparative—No Quaternary Debonder

A pilot uncreped throughdried tissue machine configured similarly to that illustrated in the above-mentioned Rugowski et al. patent was used to produce a one-ply, non-layered, uncreped throughdried towel basesheet. More specifically, 100 pounds of bleached northern softwood kraft fiber were dispersed in a pulper for 30 minutes at a consistency of 3 percent. The thick stock slurry was then passed through a refiner and refined to a Canadian Standard Freeness of 622 ml. The thick stock was then sent to a machine chest and diluted to a consistency of 1 percent.

Figure 1:
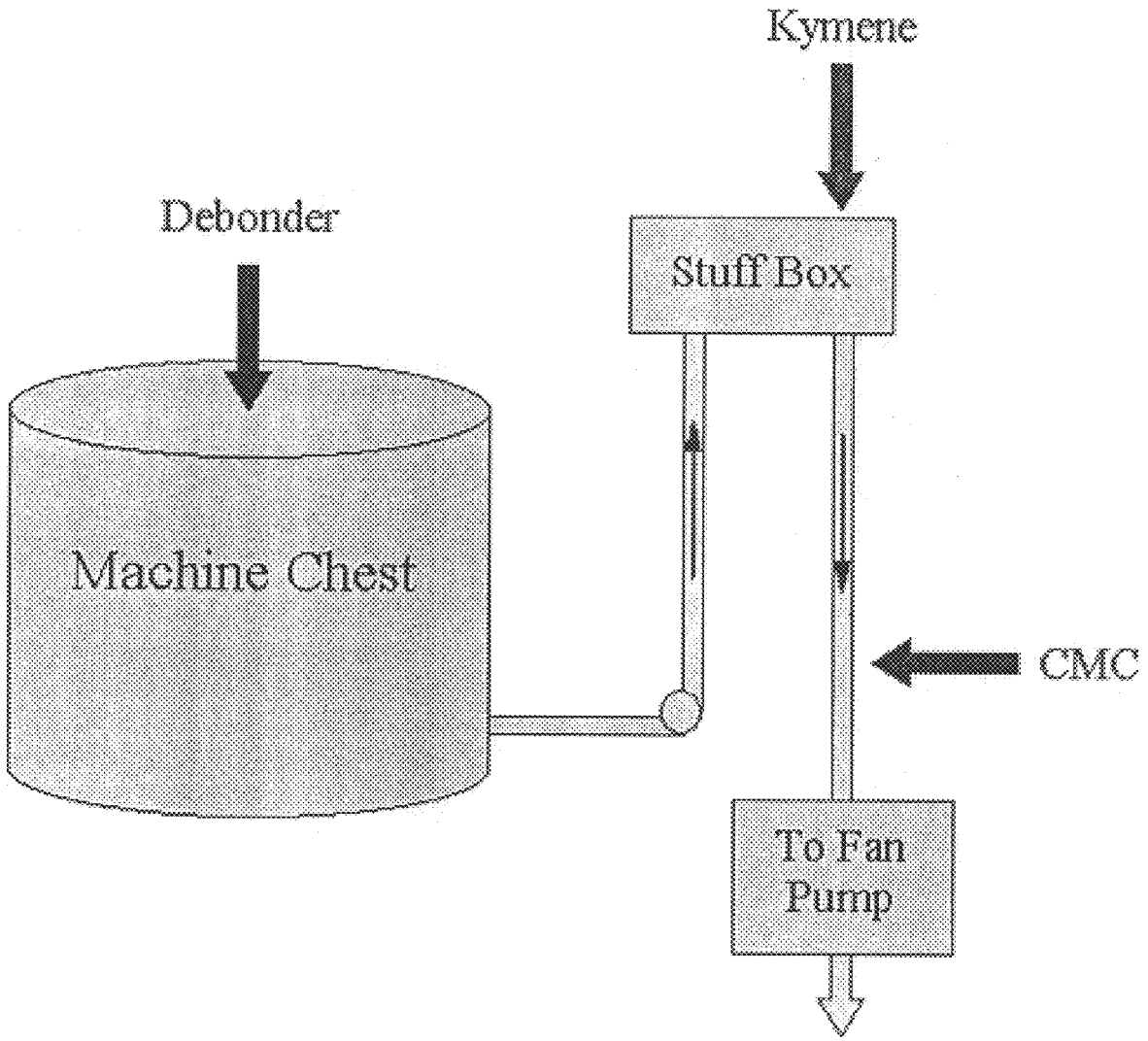
FIG. 1 is a schematic diagram of the stock preparation system for a continuous operation, illustrating the points of chemical addition for the debonder, the wet strength agent (Kymene®) and the dry strength agent (CMC).

Chemical addition points for the pulp were as shown in FIG. 1. A wet strength agent was added first (Kymene® 6500, Hercules Inc.), followed by the addition of a dry strength agent, CMC (Aqualon CMC 7MT, Hercules Inc.). The Kymene® 6500, diluted to approximately 0.56% active solids, was pumped into the stock outlet from the stuffbox by a chemical addition pump at 500 mL/min. This equates to a wet strength chemical addition level of 20 lbs. Kymene® 6500/tonne of dry fiber. The CMC, diluted to 0.71% with warm water and agitation, was pumped into the stock flow pipe between the stuffbox and the fan pump with a chemical addition pump, only a few seconds after the Kymene® addition point. CMC was supplied at a flow rate of 145 mL/min, which equates to 7.3 lbs. CMC/tonne of dry fiber.

The paper machine was configured in an uncreped throughdried mode to produce a one-ply towel basesheet. The machine chest furnish containing the chemical additives was diluted to approximately 0.1% consistency and delivered to a forming fabric using a flow spreading headbox. The forming fabric speed was approximately 62 fpm. The basesheet was then rush transferred to a fabric traveling 25% slower than the forming fabric using a vacuum shoe to assist the transfer. At a second vacuum shoe assisted transfer, the basesheet was delivered onto a t1203-2 (Voith Fabrics) throughdrying fabric. The sheet was dried with a through-dryer operating at a temperature of 375° C. Towel basesheet was produced with a 40.4 gsm oven dry basis weight. The resulting product was aged for 12 days without artificial curing and equilibrated for at least 4 hours in TAPPI Standard conditions (73° F., 50% relative humidity) before testing. All testing was performed on basesheet from the pilot machine without further processing.

The resulting basesheet physical properties are shown in TABLE 1 below:

TABLE 1

| Example | Debonder lb./tonne | CD Dry Tensile (g/3 in) | CD Wet Tensile (g/3 in) | CD wet/dry ratio (%) | MD Dry Tensile (g/3 in) | MD Stiffness (Kg/3 in.) |
|---|---|---|---|---|---|---|
| 1 | 0 | 4726 | 1848 | 39 | 4658 | 37.6 |

Examples 2–4

This Invention

In examples 2–4, the method of the invention was used to produce uncreped throughdried towel basesheets using the same machine and conditions as described in Example 1, the only difference being that a debonding agent was added to the furnish in Examples 2–4 to control the dry tensile strength. Debonder codes were prepared using a commercially available oleyl imidazoline quaternary ammonium compound (C-6027 manufactured and sold by Goldschmidt Chemical Corp.). Debonder addition was calculated based on the dry weight of pulp in the machine chest. The debonder was added as a 1% emulsion directly to the fiber in the machine chest. The time allowed for debonder dispersion and retention was between five and ten minutes before production began. The Kymene® 6500 and CMC addition levels for the trial remained constant at 20 pounds Kymene® 6500/tonne and 7.3 pounds CMC/tonne. The resulting product was aged for 12 days without artificial curing and equilibrated for at least 4 hours in TAPPI Standard conditions (73° F., 50% relative humidity) before testing. All testing was performed on basesheet from the pilot machine without further processing.

The results of the pilot machine data for Examples 1–4 are summarized in TABLE 2 below:

TABLE 2

| Example | Debonder lb./tonne | CD Dry Tensile (g/3 in.) | CD Wet Tensile (g/3 in.) | CD wet/dry ratio (%) | MD Dry Tensile (g/3 in) | MD Stiffness (Kg/3 in.) |
|---|---|---|---|---|---|---|
| 1 | 0 | 4726 | 1848 | 39 | 4658 | 37.6 |
| 2 | 5 | 3377 | 1756 | 52 | 4210 | 26.2 |
| 3 | 10 | 2345 | 1631 | 70 | 2966 | 22.2 |
| 4 | 20 | 1548 | 902 | 58 | 1951 | 21.9 |

Figure 2:
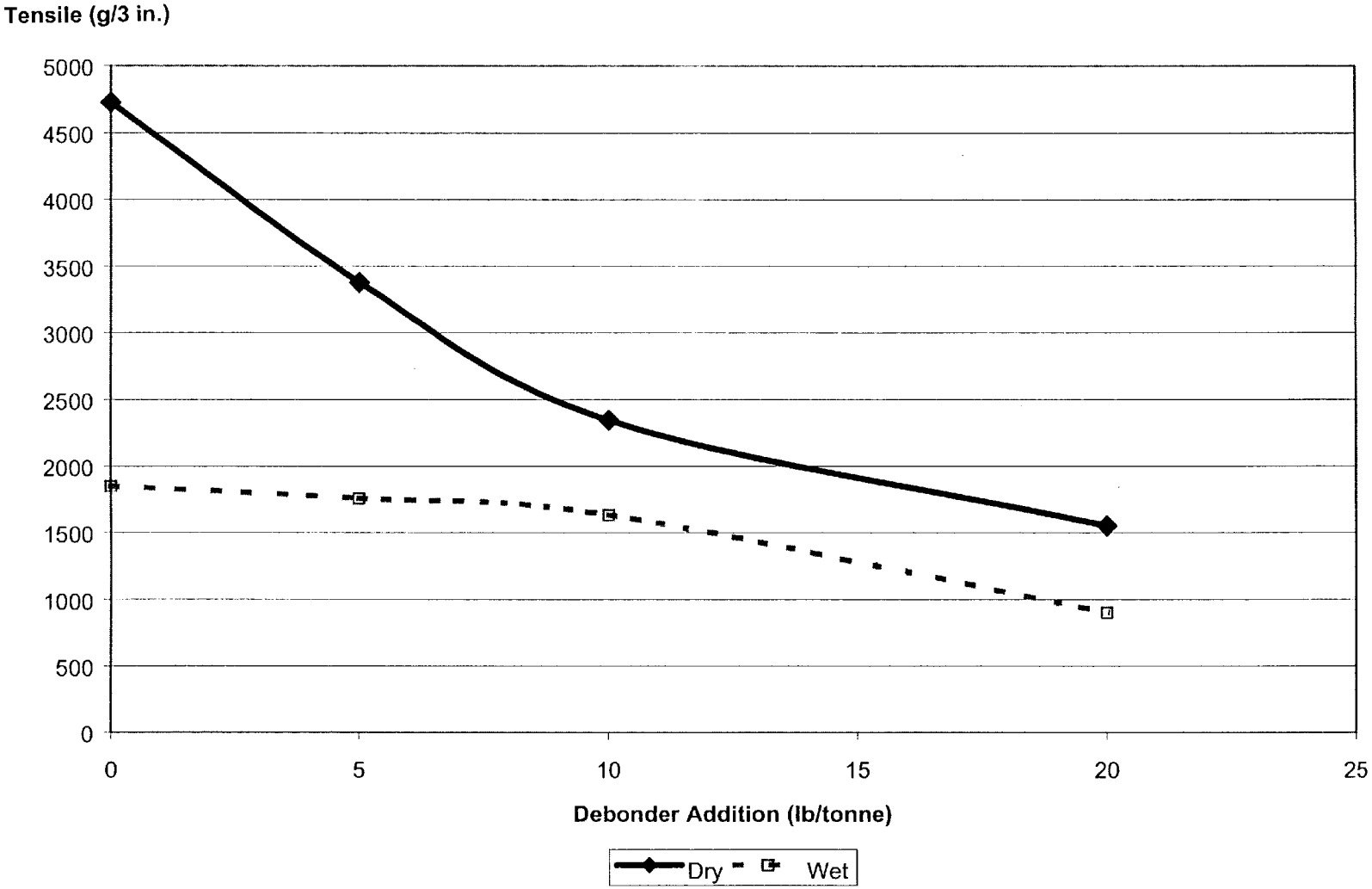
FIG. 2 is a plot of dry CD tensile strength as a function of imidazoline quaternary ammonium debonder addition for uncreped throughdried towels having 20 pounds of polyamide-epichlorohydrin wet strength resin and 7.3 pounds of CMC dry strength agent per metric ton of dry fiber.

A plot of CD tensile strength versus debonder addition level is shown in FIG. 2. As debonder is added, the dry CD tensile strength initially decreases at a faster rate than the wet CD tensile strength. Without wishing to be bound by theory, at low addition levels the debonder is effectively disrupting the hydrogen bonding responsible for the majority of the dry CD tensile strength development, while not impacting the covalent bonding imparted by the wet strength agent. Above 10 pounds/tonne debonder, both the dry and wet CD tensile strengths decrease at approximately the same rate.

Figure 3:
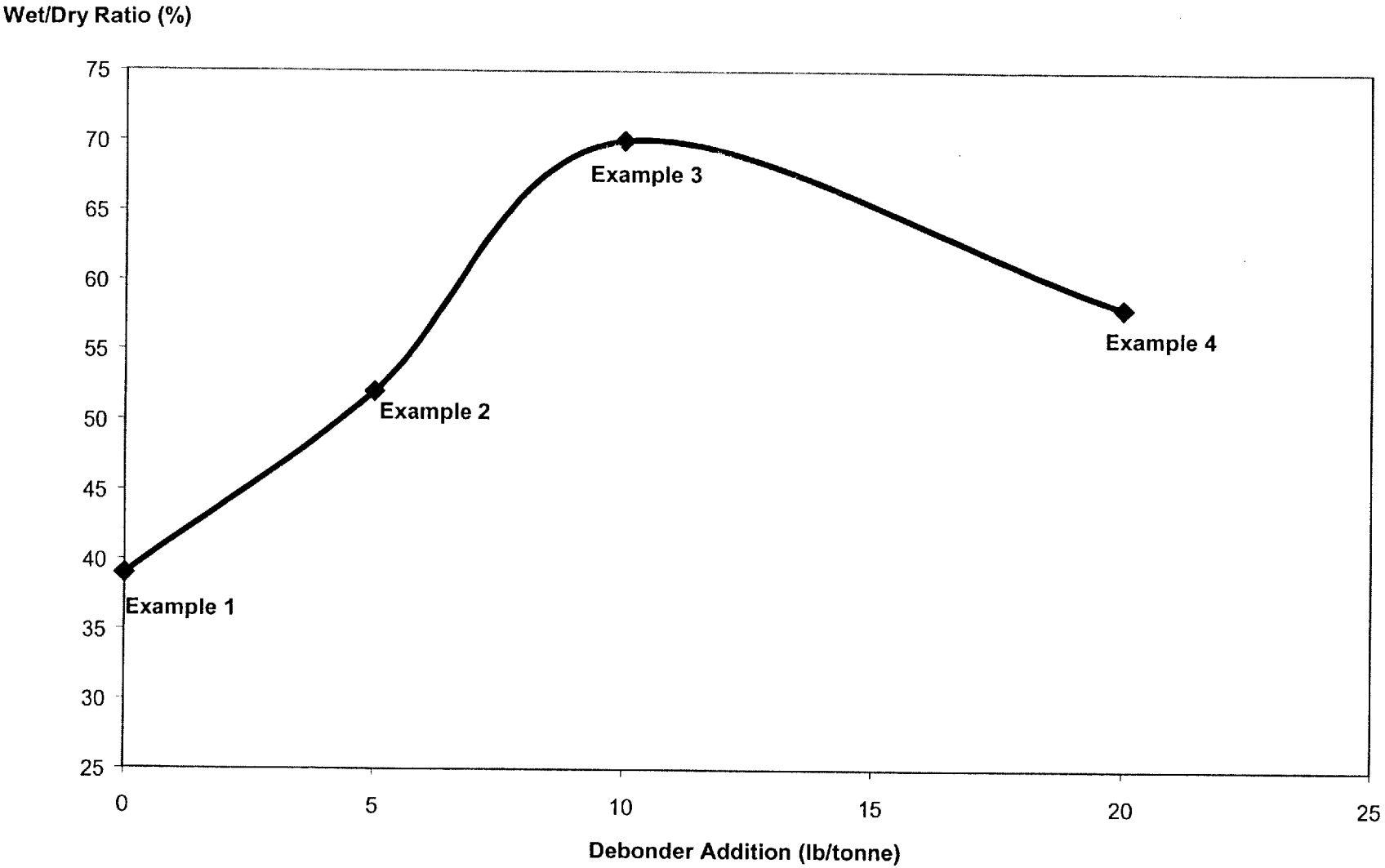
FIG. 3 is a plot of the Wet/Dry Ratio as a function of imidazoline quaternary ammonium debonder addition for uncreped throughdried towels having 20 pounds polyamide-epichlorohydrin wet strength resin and 7.3 pounds of CMC dry strength agent per metric ton of dry fiber.

FIG. 3 shows the impact of debonder addition on the Wet/Dry Ratio. The addition of debonder to a sheet containing Kymene® and CMC increases the Wet/Dry Ratio.

Examples 5–10

Commercial Creped Towels

A sample of white Bounty® Towel (The Proctor & Gamble Corporation) was tested for dry and wet CD tensile strength as described above. The towel had a Wet/Dry Ratio of 0.42.

A sample of white Hi-Dri® Towel (Kimberly-Clark Corporation) was tested for dry and wet CD tensile strength as described above. The towel had a Wet/Dry Ratio of 0.35.

A sample of white SCOTT® Towel (Kimberly-Clark Corporation) was tested for dry and wet CD tensile strength as described above. The towel had a Wet/Dry Ratio of 0.42.

A sample of white Sparkles Towel (Georgia-Pacific Corporation) was tested for dry and wet CD tensile strength as described above. The towel had a Wet/Dry Ratio of 0.33.

A sample of white Coronets Towel (Georgia-Pacific Corporation) was tested for dry and wet CD tensile strength as described above. The towel had a Wet/Dry Ratio of 0.36.

A sample of Brawny® Towel (Georgia-Pacific Corporation) was tested for dry and wet CD tensile strength as described above. The towel had a Wet/Dry Ratio of 0.32.

Figure 4:
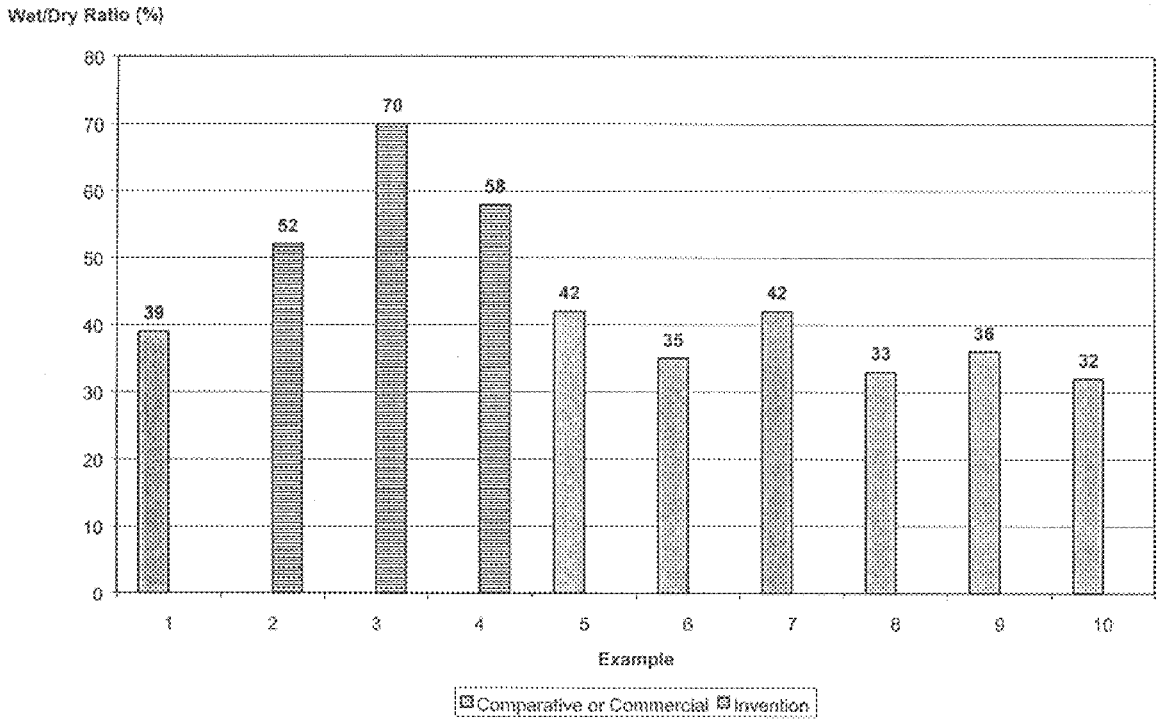
FIG. 4 is a bar chart of the Wet/Dry Ratio for the specimens described in Examples 1–10.

FIG. 4 is a bar chart illustrating the Wet/Dry Ratio for paper towels of this invention as compared to the commercial towels above. As shown, the paper towels comprising the uncreped sheets of this invention exhibit significantly higher Wet/Dry Ratios.

Examples 11–12

Pilot Machine Creped Towel

A one-ply towel creped basesheet was produced using a pilot tissue machine similar to the pilot machine used for Examples 1–4, except the machine was configured in Yankee dryer, creped mode. More specifically, 100 pounds of bleached northern softwood kraft fiber were dispersed in a pulper for 30 minutes at a consistency of 3 percent. The thick stock slurry was then passed through a refiner and refined to a Canadian Standard Freeness of 622 ml. The thick stock was then sent to a machine chest and diluted to a consistency of 1 percent. Chemical addition points were as shown in FIG. 1. The debonder, C-6027®, was added as a 1% emulsion directly to the fiber in the machine chest. The time allowed for debonder dispersion and retention was between five and ten minutes before production began. The wet strength agent (Kymene®6500) and dry strength agent (Aqualon CMC 7MT) addition levels for the trial remained constant at 25 pounds Kymene® 6500/tonne and 9.1 pounds CMC/tonne.

The machine chest furnish containing the chemical additives was diluted to approximately 0.1% consistency and delivered to a forming fabric using a flow spreading headbox. The forming fabric speed was approximately 60 fpm. The web was then transferred to a felt traveling the same speed as the forming fabric. The web was then transferred to a Yankee dryer operating at a surface temperature of in excess of 200° F. A creping adhesive mixture containing Kymene® 6500 and polyvinyl alcohol was sprayed onto the dryer to control adhesion. The web was creped from the Yankee cylinder using a creping blade and wound up on a reel traveling 20% slower than the Yankee dryer. Creped towel basesheet was produced with a 37 g/m$^2$ oven dry basis weight.

The resulting product was artificially aged for 6 minutes at 105° C. prior to testing in order to facilitate curing of the wet strength agent. The resulting basesheet physical properties are shown in TABLE 3 below:

TABLE 3

| Example | Debonder lb./tonne | CD Dry Tensile (g/1 in) | CD Wet Tensile (g/1 in) | CD wet/dry ratio (%) | MD Dry Tensile (g/1 in) |
|---|---|---|---|---|---|
| 11 | 10 | 1302 | 591 | 45 | 2021 |
| 12 | 20 | 780 | 375 | 48 | 1415 |

For the creped towel produced in Examples 11 and 12, it was not possible to obtain Wet/Dry Ratios as high as 0.50. Additionally, the presence of high levels of debonder made control of the creping operation difficult, even at the slow pilot machine speed.

It will be appreciated that the foregoing examples, given for purposes of illustration, are not to be construed as limiting the scope of this invention, which is defined by the following claims and all equivalents thereto.

We claim:

1. A method of treating a papermaking pulp useful for making a paper sheet, the method comprising;

(a) adding a quaternary debonder to the pulp in an amount sufficient to significantly reduce the dry cross-machine direction (CD) tensile strength of the sheet;

(b) thereafter adding a wet strength agent to the same pulp in an amount sufficient to provide the sheet with a ratio of the wet CD tensile strength to the dry CD tensile strength (Wet/Dry Ratio) of 0.50 or greater; and (c) thereafter adding a dry strength agent to the same pulp in an amount sufficient to increase the dry CD tensile strength of the sheet.

2. The method of claim 1 wherein the amount of the quaternary debonder is from about 5 to about 30 pounds per metric ton of dry fiber.

3. The method of claim 1 wherein the amount of the wet strength agent is from about 5 to about 30 pounds per metric ton of dry fiber.

4. The method of claim 1 wherein the amount of the dry strength agent is from about 5 to about 20 pounds per metric ton of dry fiber.

5. The method of claim 1 wherein the debonder is an imidazoline quaternary ammonium salt.

6. The method of claim 1 wherein the wet strength agent is a polyamide-epichlorohydrin resin.

7. The method of claim 1 wherein the dry strength agent is carboxymethylcellulose.

8. The method of claim 1 wherein the papermaking pulp is refined.

9. The method of claim 1 wherein the Canadian Standard Freeness of the treated pulp is about 600 milliliters or greater.

10. The method of claim 5 wherein the wet strength agent is a polyamide-epichlorohydrin resin.

11. The method of claim 10 wherein the dry strength agent is carboxymethylcellulose.

12. The method of claim 2 wherein the amount of the wet strength agent is from about 5 to about 30 pounds per metric ton of dry fiber.

13. The method of claim 12 wherein the amount of the dry strength agent is from about 5 to about 20 pounds per metric ton of dry fiber.

14. An uncreped paper sheet comprising from about 5 to about 30 pounds of a quaternary amine debonder per metric ton of dry fiber, from about 5 to about 30 pounds of a polyamide-epichlorohydrin wet strength resin per metric ton of dry fiber and from about 5 to about 30 pounds of a dry strength agent per metric ton of dry fiber, said paper sheet having Wet/Dry Ratio of 0.50 or greater and a machine direction stiffness of about 30 kilograms or less per 3 inches of width.

15. The paper sheet of claim 14 having a Wet/Dry Ratio of from 0.50 to about 0.80.

16. The paper sheet of claim 14 having a Wet/Dry Ratio of from about 0.50 to about 0.70.

17. The paper sheet of claim 14 having a machine direction stiffness of about 25 kilograms or less per 3 inches of width.

18. The paper sheet of claim 14 having a machine direction stiffness of from about 5 to about 30 kilograms per 3 inches of width.

19. An uncreped paper sheet comprising from about 5 to about 30 pounds of a quaternary ammonium debonder per metric ton of dry fiber, from about 5 to about 30 pounds of a polyamide-epichlorohydrin wet strength resin per metric ton of dry fiber and from about 5 to about 30 pounds of a dry strength agent per metric ton of dry fiber, wherein the ratio of the Wet/Dry Ratio to the machine direction stiffness is about 0.015 or greater.

20. The paper sheet of claim 19 wherein the ratio of the Wet/Dry Ratio to the machine direction stiffness is from about 0.015 to about 0.04.

21. The paper sheet of claim 19 wherein the ratio of the Wet/Dry Ratio to the machine direction stiffness is from about 0.02 to about 0.04.

22. A method of treating a softwood papermaking pulp useful for making a paper sheet the method comprising:

(a) adding a quaternary debonder to the softwood pulp in an amount sufficient to significantly reduce the dry cross-machine direction (CD) tensile strength of the sheet:

(b) thereafter adding a wet strength agent to the softwood pulp in an amount sufficient to provide the sheet with a ratio of the wet CD tensile strength to the dry CD tensile strength (Wet/Dry Ratio) of 0.50 or greater; and (c) thereafter adding a dry strength agent to the softwood pulp in an amount sufficient to increase the dry CD tensile strength of the sheet.

23. The method of claim 22 wherein the amount of the quaternary debonder is from about 5 to about 30 pounds per metric ton of dry fiber.

24. The method of claim 22 wherein the amount of the wet strength agent is from about 5 to about 30 pounds per metric ton of dry fiber.

25. The method of claim 22 wherein the amount of the dry strength agent is from about 5 to about 20 pounds per metric ton of dry fiber.

26. The method of claim 22 wherein the debonder is an imidazoline quaternary ammonium salt.

27. The method of claim 22 wherein the wet strength agent is a polyamide-epichlorohydrin resin.

28. The method of claim 22 wherein the dry strength agent is carboxymethylcellulose.

29. The method of claim 22 wherein the papermaking pulp is refined.

30. The method of claim 22 wherein the Canadian Standard Freeness of the treated pulp is about 600 milliliters or greater.

31. The method of claim 26 wherein the wet strength agent is a polyamide-epichlorohydrin resin.

32. The method of claim 26 wherein the dry strength agent is carboxymethylcellulose.

33. The method of claim 23 wherein the amount of the wet strength agent is from about 5 to about 30 pounds per metric ton of dry fiber.

34. The method of claim 33 wherein the amount of the dry strength agent is from about 5 to about 20 pounds per metric ton of dry fiber.

35. A single-ply uncreped paper sheet consisting essentially of softwood fibers, said sheet comprising from about 5 to about 30 pounds of a quaternary amine debonder per metric ton of dry fiber, from about 5 to about 30 pounds of a polyamide-epichlorohydrin wet strength resin per metric ton of dry fiber and from about 5 to about 30 pounds of a dry strength agent per metric ton of dry fiber, said paper sheet having Wet/Dry Ratio of 0.50 or greater and a machine direction stiffness of about 30 kilograms or less per 3 inches of width.

36. The paper sheet of claim 35 having a Wet/Dry Ratio of from 0.50 to about 0.80.

37. The paper sheet of claim 35 having a Wet/Dry Ratio of from about 0.50 to about 0.70.

38. The paper sheet of claim 35 having a machine direction stiffness of about 25 kilograms or less per 3 inches of width.

39. The paper sheet of claim 35 having a machine direction stiffness of from about 5 to about 30 kilograms per 3 inches of width.

40. A single-ply uncreped paper sheet consisting essentially of softwood fibers, said sheet comprising from about 5 to about 30 pounds of a quaternary ammonium debonder per metric ton of dry fiber, from about 5 to about 30 pounds of a polyamide-epichlorohydrin wet strength resin per metric ton of dry fiber and from about 5 to about 30 pounds of a dry strength agent per metric ton of dry fiber, wherein the ratio of the Wet/Dry Ratio to the machine direction stiffness is about 0.015 or greater.

41. The paper sheet of claim 40 wherein the ratio of the Wet/Dry Ratio to the machine direction stiffness is from about 0.015 to about 0.04.

42. The paper sheet of claim 40 wherein the ratio of the Wet/Dry Ratio to the machine direction stiffness is from about 0.02 to about 0.04.

* * * * *